United States Patent [19]

Wolcott

[11] Patent Number: 4,696,327

[45] Date of Patent: Sep. 29, 1987

[54] BAND FINISHING TOOL

[75] Inventor: Wayne B. Wolcott, Englewood, Ohio

[73] Assignee: Electro Adapter, Chatsworth, Calif.

[21] Appl. No.: 875,579

[22] Filed: Jun. 18, 1986

[51] Int. Cl.[4] ..... B21F 15/00

[52] U.S. Cl. ..... 140/150; 72/211; 72/312

[58] Field of Search ..... 140/93 D, 93.4, 123, 140/150, 153, 154; 81/9.3; 72/211; 29/243.5, 243.57, 243.58; 72/312, 313, 409, 460

[56] References Cited

U.S. PATENT DOCUMENTS 2,722,858 11/1955 Oyen ..... 72/312

4,446,894 5/1984 Larson ..... 29/243.56

*Primary Examiner*—Lowell A. Larson

*Attorney, Agent, or Firm*—Harris, Kern, Wallen & Tinsley

[57] ABSTRACT

A tool for finishing a banding operation with a metal band which includes an integral buckle bends the tip of the free end of the band and then folds such free end back into overlying relation with the band buckle in such manner that no sharp edges of the band or the buckle are exposed.

7 Claims, 7 Drawing Figures

BAND FINISHING TOOL

BACKGROUND OF THE INVENTION

The present invention relates to a band finishing tool and, more particularly, to a tool for finishing a banding operation with a metal band by initially bending the tip of the free end of a band and then folding the free end back over the band buckle so that the free end of the band and the band buckle surface are nearly contiguous and that no sharp edges of the band or the buckle are exposed while maintaining a predetermined pressure on the band about an article.

The ability to bend the tip of the free end of a band and then fold it back over the band buckle by merely compressing the free end of the band into near proximity with the outer surface of the band buckle is a very desirable feature of a band finishing tool utilized in electrical conduit banding. No band finishing tool is presently known which incorporates these features.

Banding tools are well known and are used for a wide variety of banding operations. However, when utilizing a conventional banding tool, there is normally no need for a band finishing tool. These conventional banding tools usually consist of two rotary wheels with teeth operatively connected to arms operating in a scissors-like manner. Banding material is initially fed between the rotary wheels. The arms are alternately compressed and released while pulling the banding material into the tool until the banding material has been tightened around the article. At this point, a band buckle is placed over the overlapping portions of the band, and a crimping tool is applied to crimp the band buckle about the two overlapping portions of the band. After the band has been secured by the crimping buckle to complete the banding operation, the end of the band is severed in the vicinity of the buckle.

This type of banding method and banding tool cannot be utilized with bands having a band buckle as an integral portion of the band. With this type of band, such as those utilized in applications in aircraft electronic conduit backshells, it is important that a particular predetermined pressure range be accurately incorporated into the band about the backshell. Once this predetermined tension is automatically locked about the backshell, it then becomes necessary to retain this tension. Since the band already has an integral buckle, the conventional method of securing the band about the material by crimping a buckle over the overlapping sections is unavailable.

Accordingly, there is a need for a band finishing tool for use in conjunction with the banding tool and a band having an integral buckle which provides for first bending the tip of the free end of the band approximately 45° and thereafter folding the free end of the band back over the integral buckle into near proximity with the buckle's outer surface in order to retain the predetermined pressure in the band about the backshell or article while eliminating the exposure of any sharp or jagged edges.

SUMMARY OF THE INVENTION

The present invention provides a tool for first bending and then folding the free of a band back over the band's integral buckle and for permanently retaining the free end of the band in close proximity to the outer surface of the band buckle.

More specifically, the invention provides a unique combination of elements and a specific folding member design and method of using the same which consistently achieves the desired relationship between the free end of the band and the buckle, that being the location of the band's free end in close proximity with the outer surface of the buckle while retaining the predetermined pressure about the article.

While the present invention may be utilized for a plurality of different banding applications, one example, which was designed for application in aerospace electronic wiring systems, is as a tool for finishing bands which have been positioned about an electric backshell by a hand operated banding tool. The band must have been tightened, locked and trimmed about the backshell within a predetermined tension range, for example, 75 to 175 pounds. The specific banding tool utilized for initially positioning and tightening the band about the backshell within a desired tension range is the subject of a related patent application Ser. No. 758,598, filed July 24, 1985, which is incorporated herein by reference.

After the tension range has been locked into the band about the backshell, the banding tool disclosed in the above application is utilized to bend the excess banding material or free end of the band to a position approximately 90° to the band's integral buckle so that the predetermined tension is locked in the band about the backshell. Next, the banding tool severs the excess banding material from the band about the backshell to a predetermined length or free end of the band. The predetermined length, which is folded back over the buckle, is selected to coincide approximately with the length of the band buckle.

At this point, the band finishing tool of the present invention is utilized to bend the tip of the free end of the band approximately 45° toward the buckle surface. This bent portion is designed to be crimped or folded slightly around the opposite end of the band buckle from the free end of the band when the band finishing tool has completed the fold over operation. Once the tip of the free end of the band is so bent, the band finishing tool is then utilized to fold the free end of the band with the bent tip back over the buckle into overlying relation with the buckle such that the free end and tip are wrapped around the band buckle in close proximity thereto.

Accordingly, it is an object of the present invention to provide a band finishing tool which may be utilized with a wide variety of banding materials having an integral buckle and to provide for first bending the tip of the free end and then for folding the free end of the band back over the integral band buckle into overlying relation with the buckle such that no sharp edges protrude from the tip of the free end or from the area of contact between the free end and the integral buckle while the predetermined tension in the band around the backshell or other article is maintained.

Other objects and advantages of the invention will be apparent from the following description, the accompanying drawings and the appended claims.

DETAILED DESCRIPTION OF THE PREFERRED EMBODIMENT

Figure 2:
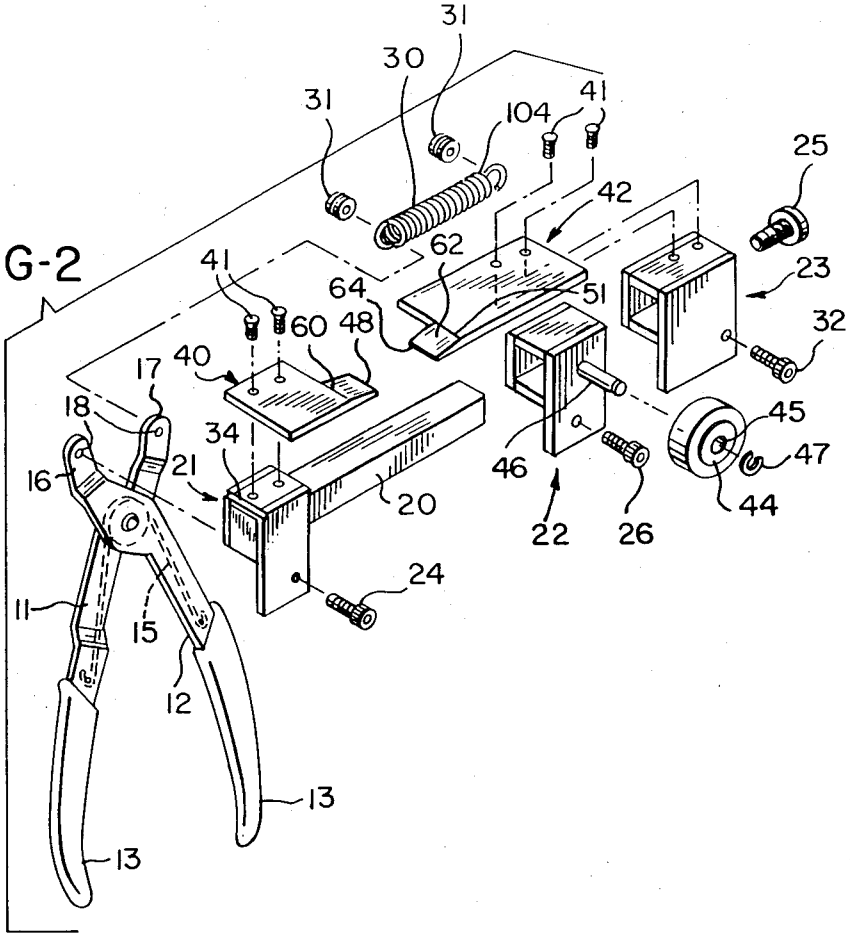
FIG. 2 is a exploded perspective view of the tool shown in FIG. 1.
Figure 1:
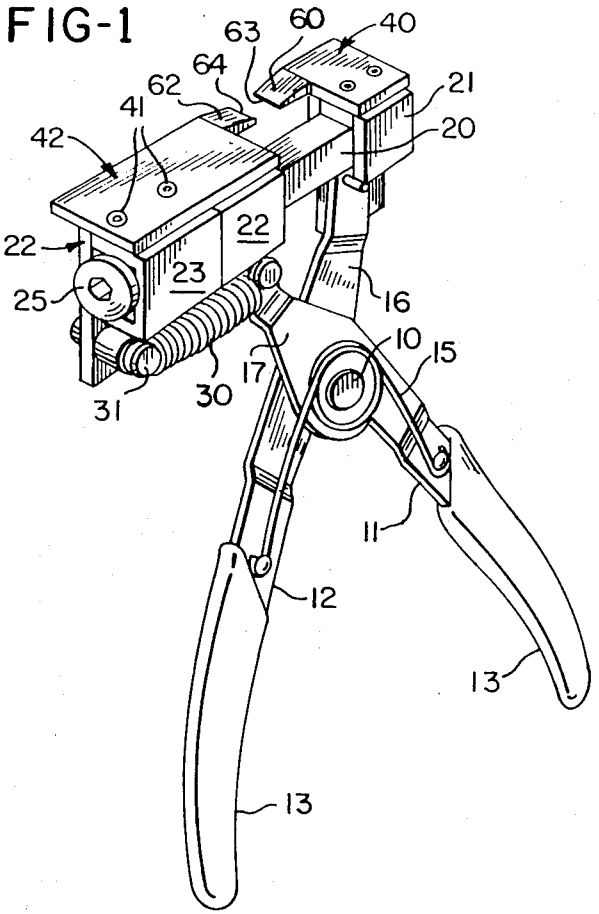
FIG. 1 is a perspective view of the band finishing tool of the present invention.

Referring to FIGS. 1 and 2, the band finishing tool of the invention is operated by a scissors assembly comprising two double lever arms which are crossed and pivotally connected at 10 similarly to conventional scissors or pliers. The longer arms 11–12 form the handles of the scissors and have protective glove covers 13. A torsion spring 15, which biases the handles apart, is connected to each of arms 11–12 and to the pivot 10 therebetween. The other arms 16–17 of the scissors assembly are laterally offset into coplanar relation, and each of these arms is provided with a pivot hole 18 which is utilized to secure the arm to an operating component of the tool.

These components include a rectangular rod member 20 and three generally P-shaped members 21, 22 and 23 each having a rectangular opening therethrough sized for slidable assembly on the rod 20. One of the P-shaped members 21 is permanently secured on one end of the rod 20, as by brazing or the like, and this member 21 is pivotally mounted on the scissors arm 16 by a screw 24 in the hole 18 in arm 16. The other two P-shaped members 22 and 23 are slidably mounted on the rod 20 and are retained thereon by a screw 25 or other conventional means on the end of the rod 20.

The middle P-shaped member 22 is pivotally connected to the scissors arm 17 by a screw 26 in the hole 18 in arm 17. The third P-shaped member is free to slide on rod 20, but it is attached to the other sliding member 22 by a coil spring 30, which has its opposite ends connected to the members 22 and 23, as by means of nuts 31 on the screws 36 and 32 or other conventional means.

A generally rectangular plate 40 is firmly mounted on the fixed P-shaped member 21, by screws 41 or other conventional means. A longer rectangular plate 42 is similarly mounted on the outer slidably mounted P-shaped member 23, but it is long enough to extend over and in relatively slidable relation with the middle P-shaped member 22. A roller 44, having a cover 45 of urethane rubber or the like, is rotatably mounted on the middle P-shaped member 22 by a stud 46 which is at right angles to the length of bar 20 and parallel with the two plates 40 and 42. A C-clip 47 or other retaining member holds the roller 44 on the stud 46.

The remainder of the tool is most readily described in connection with its use, as illustrated in FIGS. 3–6, to finish the buckled end of a metal band 50 that has been wrapped around an article 52 and includes an integral buckle 55 through which the free end 56 of the band has been threaded, tightened around the article 52 to the desired tension, and then bent back through approximately 90° and cut off.

Figure 4:
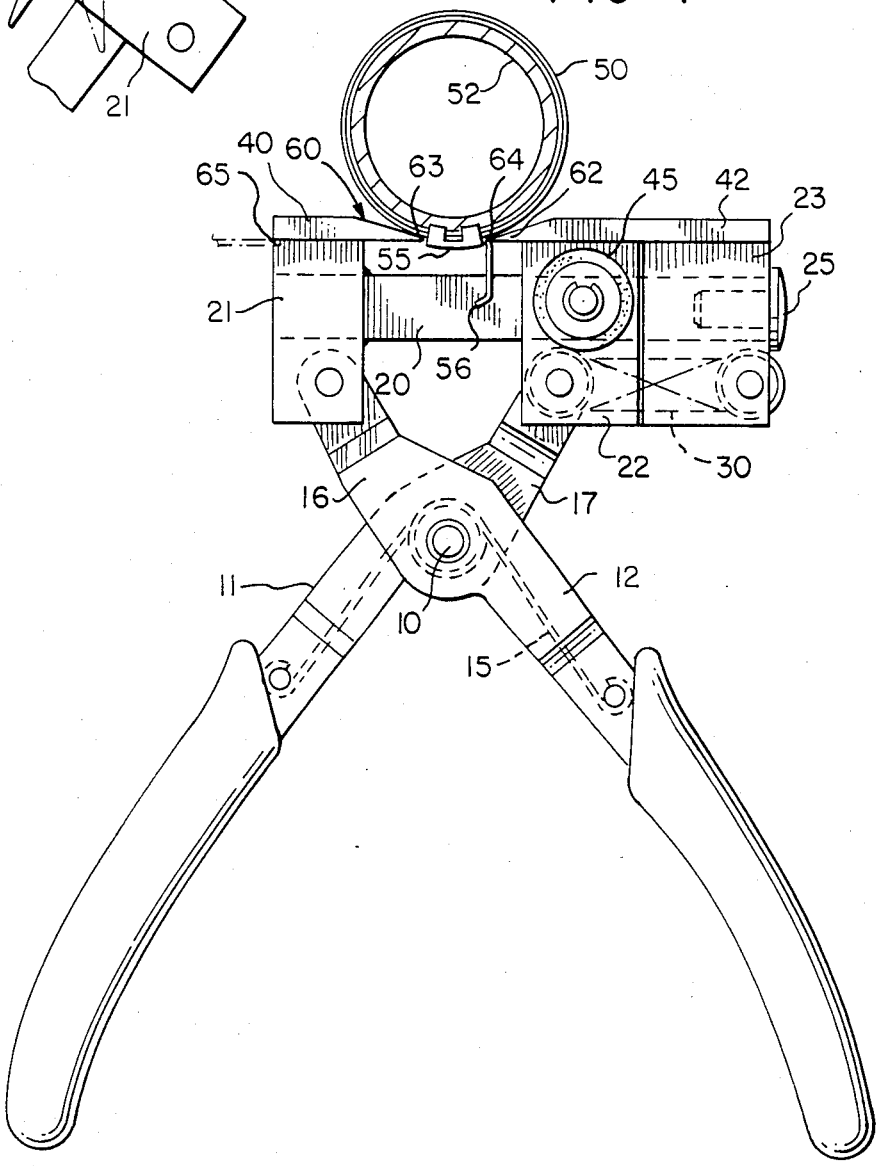
FIG. 4 is a side view of the tool of the invention positioned to commence the finishing operation.
Figure 5:
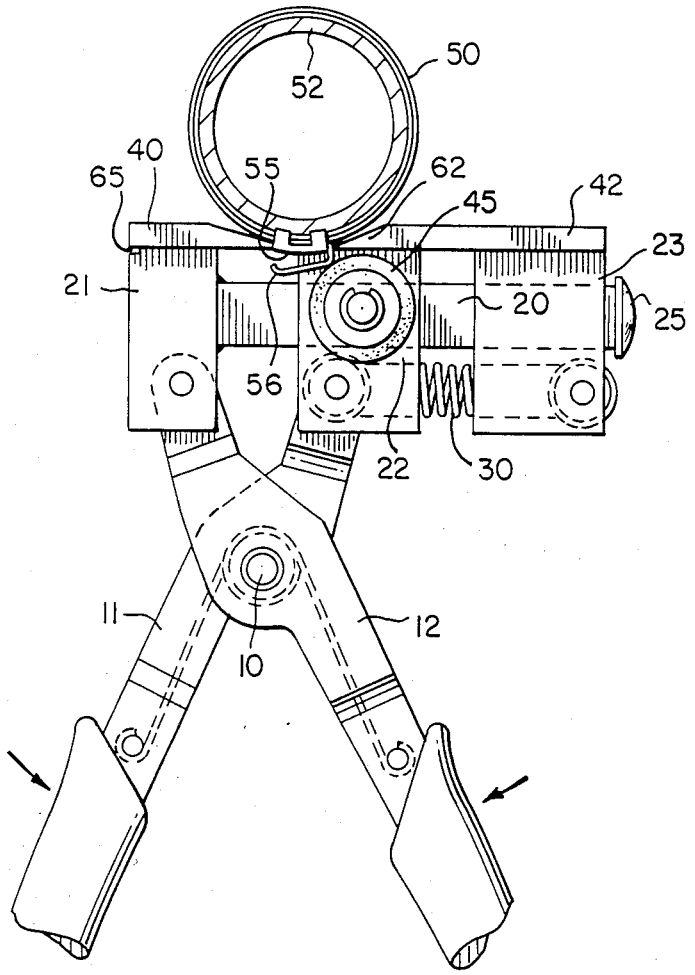
FIG. 5 is a side view of the tool at an intermediate stage of the band finishing operation.
Figure 7:
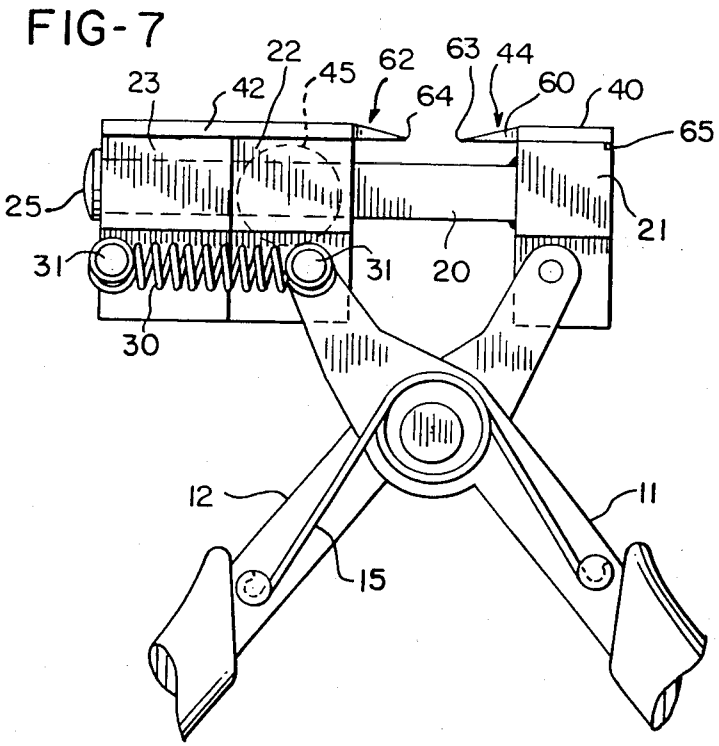
FIG. 7 is an end elevation of the tool during the finishing operation.

Each of the two plates 40 and 42 includes a buckle-engaging blade 60, 62 of rectangular outline designed to match with a band buckle 55 of specific width. As shown in FIG. 4, each blade 60–62 has a beveled surface terminating in a knife-edge 63–64, and these two knife edges are aligned in facing relation with each other.

Figure 3:
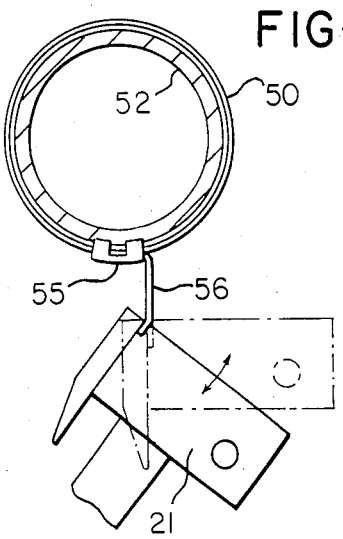
FIG. 3 is a partial end view showing the operation of bending the tip of the free end of the banding material at approximately a 45° angle toward the band so that when the fold over is completed no shape edges are exposed.

As shown in FIG. 3, a narrow rectangular slot 65 proportioned to receive a band 50 of specific width is formed at the junction of the plate 40 and the fixed P-shaped member 21. This slot 65 is parallel to the plane of plate 40, and its depth is determined by the length of the tip portion 66 of the end of the band which is to be turned about the buckle 55. At the start of a finishing operation, the tip end of the band is inserted into the slot 65, and the tool is then rotated with respect to the remainder of the free end of the band until the band tip 66 has been bent at approximately 45° to the adjacent portion 56 of the band as shown in FIG. 3.

When this intermediate bending operation has been completed, the tool is then positioned with the fixed P-shaped member 21 and the associated plate 40 on the side of the buckle 55 away from the free band end 56, as shown in FIG. 4, and with the knife edge 63 set in the recess between the end of the buckle and the band. The scissor handles 11 and 12 are then forced toward each other, so that the middle P-shaped member 22 moves to the left as viewed in FIGS. 4–6.

Figure 6:
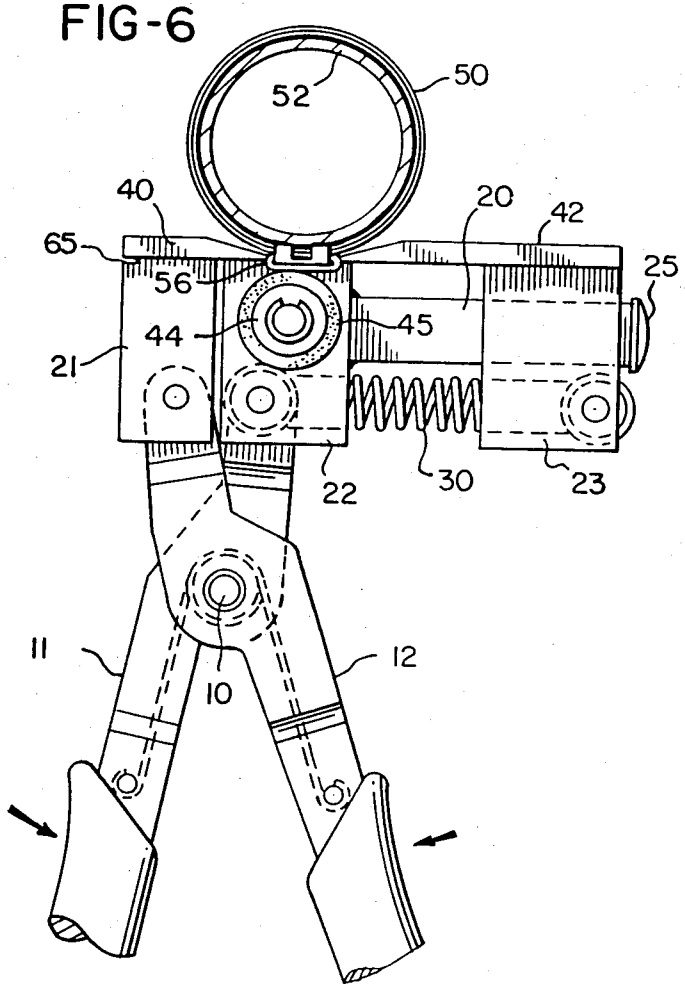
FIG. 6 is a side view similar to FIG. 5 showing the tool upon completion of the band finishing operation.

During the first part of this movement, the P-shaped member 23 will be pulled along the rod 20 by the spring 30, until the knife edge 64 thereon fits in the recess between the buckle and the band, after which the members 21 and 23 remain in fixed relatively spaced relation. The middle P-shaped element 22 therefore moves to the left away from the member 23, and against the tensioning force of the spring 30. During this movement, the cover 45 on the roller 44 will engage the free end 56 of the band and force it to the left, until when the operating stroke is completed, the band end 56 will have been formed around the end of the buckle and into overlying relation with the outer surface of the buckle until its bent-over tip 66 fits around the other end of the buckle, as shown in FIG. 6.

It is important to the obtaining of optimum results with the tool of the invention that the cover 45 of the roller 44 have properties of both resiliency and non-compressibility, which will enable it to form the entire free end 56 of the band into closely overlying relation with the buckle. Consistent results from this standpoint have been obtained with the cover 45 formed of urethane rubber having a durometer reading of A90.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. Apparatus for folding the free end of a band back over a band buckle, comprising:

(a) a scissors assembly including a pair of handles and a pair of operating arms pivotally interconnected for movement toward and away from each other, (b) complementary means on said arms for gripping the opposite ends of the buckle in line with the band end, and (c) means on one of said arms responsive to movement of said arms toward each other for bending the band end into overlying relation with the buckle.

2. Apparatus as defined in claim 1 wherein said bending means comprises a roller mounted for rotation on said one arm and for movement laterally therewith with respect to the gripped buckle.

3. Apparatus for folding the free end of a band back over a band buckle, comprising:

(a) a scissors assembly including a pair of handles and a pair of operating arms pivotally interconnected for movement toward and away from each other, (b) a buckle gripping element mounted on one of said arms, (c) a rod projecting from said gripping element at right angles to the pivotal axis of said scissors assembly, (d) a complementary buckle gripping element mounted for sliding movement on said rod, (e) a band bending element slidably mounted on said rod between said gripping elements, (f) means connecting said bending element to the other of said scissors arms for movement therewith along said rod, (g) a spring connecting said bending element and said slidable gripping element whereby movement of said bending element toward said fixed gripping element will retain said gripping elements in gripping relation with the buckle, and (h) said bending element including means responsive to movement of said scissor arms toward each other to engage and bend the band end into overlying relation with the buckle.

4. Apparatus as defined in claim 3 wherein said bending element comprises a part slidably mounted on said rod, and a roller mounted for rotation on said part and for movement laterally therewith with respect to the gripped buckle.

5. Apparatus as defined in claim 3 wherein each of said buckle gripping elements includes a knife-life edge adapted for insertion at the junction of the buckle and the band.

6. The method of finishing the junction between a band and a buckle constituting an integral part of said band, comprising the steps of:

(a) bending the free end of the band about one end of the buckle through approximately 90°; and (b) then bending said end into closely overlying relation with the buckle while at the same time causing the tip of the band end to be tucked around the adjacent end of the buckle.

7. The method defined in claim 5 further comprising the intermediate step of bending the tip of the band end through an angle of the order of 45° in the same direction in which the band end is bent about the buckle whereby said tip fits around the end of the buckle.

* * * * *